US011248871B2

(12) United States Patent
Bray

(10) Patent No.: US 11,248,871 B2
(45) Date of Patent: Feb. 15, 2022

(54) FIREARM BARREL TRUNNION

(71) Applicant: Polaris Capital Corporation, Orem, UT (US)

(72) Inventor: Ernest R. Bray, American Fork, UT (US)

(73) Assignee: Polaris Capital Corporation, Orem, UT (US)

( * ) Notice: Subject to any disclaimer, the term of this patent is extended or adjusted under 35 U.S.C. 154(b) by 0 days.

(21) Appl. No.: 17/121,556

(22) Filed: Dec. 14, 2020

(65) Prior Publication Data

US 2021/0180904 A1 Jun. 17, 2021

Related U.S. Application Data

(60) Provisional application No. 62/947,494, filed on Dec. 12, 2019.

(51) Int. Cl.

| | |
|---|---|
| ***F41C 23/16*** | (2006.01) |
| ***F41A 21/48*** | (2006.01) |
| ***F41A 3/66*** | (2006.01) |
| ***F41A 17/46*** | (2006.01) |
| ***F41A 3/72*** | (2006.01) |
| ***F41A 19/11*** | (2006.01) |
| ***F41G 11/00*** | (2006.01) |

(52) U.S. Cl.

CPC ..... *F41A 21/48* (2013.01); *F41A 3/66* (2013.01); *F41A 3/72* (2013.01); *F41A 17/46* (2013.01); *F41A 19/11* (2013.01); *F41C 23/16* (2013.01); *F41G 11/003* (2013.01)

(58) Field of Classification Search

CPC ..... F41C 23/16

USPC ..... 42/75.03, 72, 71.01

See application file for complete search history.

(56) References Cited

U.S. PATENT DOCUMENTS

| | | | | |
|---|---|---|---|---|
| 2010/0269682 | A1 | 10/2010 | Vuksanovich et al. | |
| 2015/0192385 | A1* | 7/2015 | Krebs | F41C 23/16 42/71.01 |
| 2015/0292825 | A1 | 10/2015 | Cassels | |
| 2016/0033218 | A1 | 2/2016 | Folkestad, II et al. | |
| 2016/0348990 | A1 | 12/2016 | Steil | |
| 2017/0176135 | A1 | 6/2017 | Fesas | |
| 2017/0248390 | A1 | 8/2017 | Keeney | |
| 2017/0314880 | A1 | 11/2017 | Dienno | |
| 2019/0101355 | A1 | 4/2019 | Hubbell et al. | |

(Continued)

FOREIGN PATENT DOCUMENTS

WO 99/05467 A1 2/1999

OTHER PUBLICATIONS

PCT/US2020/064942, "Notification of Transmittal of the International Search Report and the Written Opinion of the International Searching Authority, or the Declaration", ISR, dated Feb. 25, 2021, pp. 1-8.

*Primary Examiner* — Reginald S Tillman, Jr.

(74) *Attorney, Agent, or Firm* — Kunzler Bean & Adamson

(57) ABSTRACT

Apparatuses, systems, and methods are disclosed for use in or with firearms. A firearm barrel trunnion includes a rear portion shaped to couple to a receiver for a firearm. The trunnion includes a front portion shaped to couple to a handguard for the firearm and to support the handguard without the handguard contacting other components of the firearm. A bore is formed within the trunnion, and is shaped to receive a barrel for the firearm.

20 Claims, 13 Drawing Sheets

(56) References Cited

U.S. PATENT DOCUMENTS

| | | | | |
|---|---|---|---|---|
| 2019/0162504 | A1* | 5/2019 | Keeney | F41C 23/16 |
| 2019/0162505 | A1* | 5/2019 | Mezynski | F41C 27/00 |

* cited by examiner

FIREARM BARREL TRUNNION

CROSS-REFERENCES TO RELATED APPLICATIONS

This application claims the benefit of U.S. Provisional Patent Application Ser. No. 62/947,494 entitled "FIREARM BARREL TRUNNION" and filed on Dec. 12, 2019 for Ernest R. Bray et al., which is incorporated herein by reference.

FIELD

The subject matter disclosed herein relates to firearms and more particularly relates to a firearm barrel trunnion.

BACKGROUND

Designs for many AK-47 type rifles prioritize quick, low-cost production methods over accuracy. Stamped sheet metal construction and high clearances between parts may result components not being aligned the same way from shot to shot. Also, contact between the barrel and other components may push the barrel in different directions (e.g., due to force on a handguard attached to the barred), or may interfere with barrel harmonics, so that the barrel vibrates or oscillates differently from shot to shot. Despite these accuracy problems, modern warfighters who need to fire accurately may want to use AK-47 type rifles for a variety of reasons, such as to utilize widely available interchangeable parts, or in circumstances when the distinctive sound of an AK-47 is expected.

SUMMARY

Apparatuses are disclosed for use in firearms. In some embodiments, a firearm barrel trunnion includes a rear portion shaped to couple to a receiver for a firearm. In further embodiments, a trunnion includes a front portion shaped to couple to a handguard for the firearm and to support the handguard without the handguard contacting other components of the firearm. In further embodiments, a bore is formed within the trunnion, and is shaped to receive a barrel for the firearm.

Various embodiments of firearms are disclosed. A firearm, in some embodiments, includes, a receiver, a barrel, a handguard, and a firearm barrel trunnion. In further embodiments, the trunnion includes a rear portion coupled to the receiver. In further embodiments, the trunnion includes a front portion coupled to the handguard, so that the front portion supports the handguard without the handguard contacting other components of the firearm. In further embodiments, a bore is formed within the trunnion, and the barrel is coupled to the bore.

Methods are disclosed for firearms. A method, in one embodiment, includes providing a receiver for a firearm. In a further embodiment, a method includes providing a barrel for the firearm, providing a handguard for the firearm, and providing a firearm barrel trunnion for the firearm. In a further embodiment, a method includes coupling a rear portion of the trunnion to the receiver, and coupling the barrel to a bore formed within the trunnion. In a further embodiment, a method includes coupling the handguard to a front portion of the trunnion, such that the front portion supports the handguard without the handguard contacting other components of the firearm.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Figure 1:
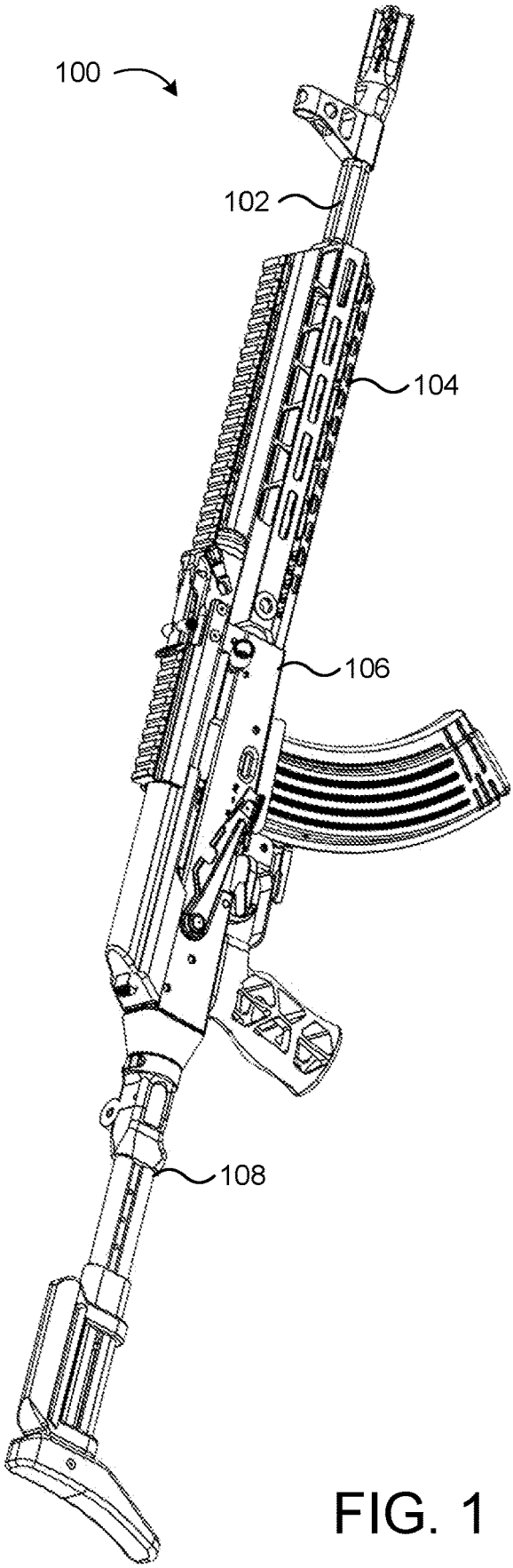
FIG. 1 is a perspective view illustrating one embodiment of a firearm.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of the invention may be combined in any suitable manner in one or more embodiments. In the following description, numerous specific details are included to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The description of elements in each figure may refer to elements of proceeding figures. Like numbers refer to like elements in all figures, including alternate embodiments of like elements.

As used herein, a list with a conjunction of "and/or" includes any single item in the list or a combination of items in the list. For example, a list of A, B and/or C includes only A, only B, only C, a combination of A and B, a combination of B and C, a combination of A and C or a combination of A, B and C. As used herein, a list using the terminology "one or more of" includes any single item in the list or a combination of items in the list. For example, one or more of A, B and C includes only A, only B, only C, a combination of A and B, a combination of B and C, a combination of A and C or a combination of A, B and C. As used herein, a list using the terminology "one of" includes one and only one of any single item in the list. For example, "one of A, B and C" includes only A, only B or only C and excludes combinations of A, B and C. As used herein, "a member selected from the group consisting of A, B, and C," includes one and only one of A, B, or C, and excludes combinations of A, B, and C." As used herein, "a member selected from the group consisting of A, B, and C and combinations thereof" includes only A, only B, only C, a combination of A and B, a combination of B and C, a combination of A and C or a combination of A, B and C.

FIG. 1 depicts a firearm 100, in one embodiment. In the depicted embodiment, the firearm 100 is an AK-47 type firearm. Terms such as "AK-47 type," "AK-47," "AK-type," "AK," "Kalashnikov rifle" and the like are used herein to refer to rifles, and their components, based on the AK-47 designed by Mikhail Kalashnikov, including but not limited to the AK-47 itself, AKM, AK-74, AK-101, AK-102, AK-103, AK-104, AK-105, AK-12, and the like. A rifle with an AK-type receiver may be referred to using the above terms, regardless of whether the receiver itself originates with the Kalashnikov Concern or whether it is made by another manufacturer to be compatible with Kalashnikov components, and regardless of the origin of components other than the receiver.

In the depicted embodiment, the firearm 100 includes a barrel 102, a handguard 104 (surrounding most of the barrel 102), a receiver 106, and a stock 108. Various other or further components of the firearm 100 are depicted, some of which are standard components for a commercially available AK-type firearm, and some of which are described in further detail below.

The receiver 106, in various embodiments, houses components of a firearm 100 for loading, firing, and ejecting ammunition, such as a bolt, bolt carrier, hammer, firing pin, trigger, and the like. The stock 108 (e.g., a folding stock in the depicted embodiment) attaches to the back of the receiver 106, and the barrel 102 attaches to the front of the receiver 106. A handguard 104 surrounds at least a portion of the barrel 102, allowing a user to aim and fire the firearm 100 while holding the pistol grip below the receiver 106 with one hand and the handguard 104 with the other hand.

Terms such as "front," "rear," "top," bottom," and the like are used herein for firearms 100 and firearm components, with reference an orientation where the firearm muzzle points forward, the stock is at the rear, and the trigger is at the bottom. These terms are used to describe relative relationships and not to imply absolute positions. For example, if the firearm 100 is held upside down, the "top" of the firearm 100 may be physically located below other components, but may still be referred to as the "top" of the firearm 100.

In some AK-47 type rifles, the receiver 106 may be made of thin metal, such as stamped sheet metal. Larger blocks of metal may be attached to the front and rear of the receiver 106 to attach and support the barrel 102 and the stock 108. Such blocks may be referred to, respectively, as front and rear trunnions. The front trunnion may also be referred to as a firearm barrel trunnion. When the "trunnion" is used herein without a modifier such as "front" or "rear," it refers to the firearm barrel trunnion, not to the rear trunnion. The trunnion is not visible in FIG. 1, but is depicted apart from the firearm 100 in subsequent figures, and described in more detail below.

For accuracy, it may be desirable for the barrel 102 of a rifle to be "free-floating" so that to the extent reasonably possible, the barrel 102 does not contact other components forward of the receiver 106 or trunnion. For example, if a handguard is coupled directly to the barrel 102, as in the original AK-47 design, force from the user's hand on the handguard may flex the barrel slightly, or interfere with the natural vibration of the barrel (referred to as barrel harmonics) when the rifle is fired. If the barrel flexes or vibrates differently from shot to shot, the accuracy of the rifle will be reduced.

However, some contact between the barrel and other components forward of the trunnion may be necessary to operate an AK-47-type firearm. For example, a gas block allows gases in the barrel 102 from firing a cartridge to expand into a gas tube above the barrel, pushing a gas piston backward in the tube. The gas piston pushes a bolt carrier back to extract the spent case, then moves forward as a recoil spring moves the bolt carrier forward to chamber the next round. (The gas block and gas tube are not visible in FIG. 1 due to being coupled to the portion of the barrel 102 that is surrounded by the handguard 104). Thus, a certain amount of reciprocating mass in the gas piston is coupled to the barrel 102 by the gas tube and gas block in any AK-47 type firearm, and it may not be possible for a barrel 102 to be fully "free-floating," free from interference from the gas piston. However, for an AK-47 type firearm, a barrel may be nevertheless be referred to as "free-floating" if forces on the handguard during use of the firearm are not transferred to the barrel 102 forward of the trunnion.

Thus, in the depicted embodiment, the trunnion itself supports the handguard 104, without the handguard 104 contacting other components of the firearm 100. Because the handguard 104 does not contact other components of the firearm 100 such as the barrel 102 or the gas tube (where lower and upper handguards are respectively mounted in the original AK-47 design), forces on the handguard during use of the firearm 100 are not transferred to the barrel 102 directly, or indirectly via the gas block. Thus, the barrel 102 is free-floating in the sense that forces on the handguard during use of the firearm 100 are not transferred to the barrel 102 except via the trunnion, providing improved accuracy over AK-47 type rifles without a free-floating barrel.

Figure 2:
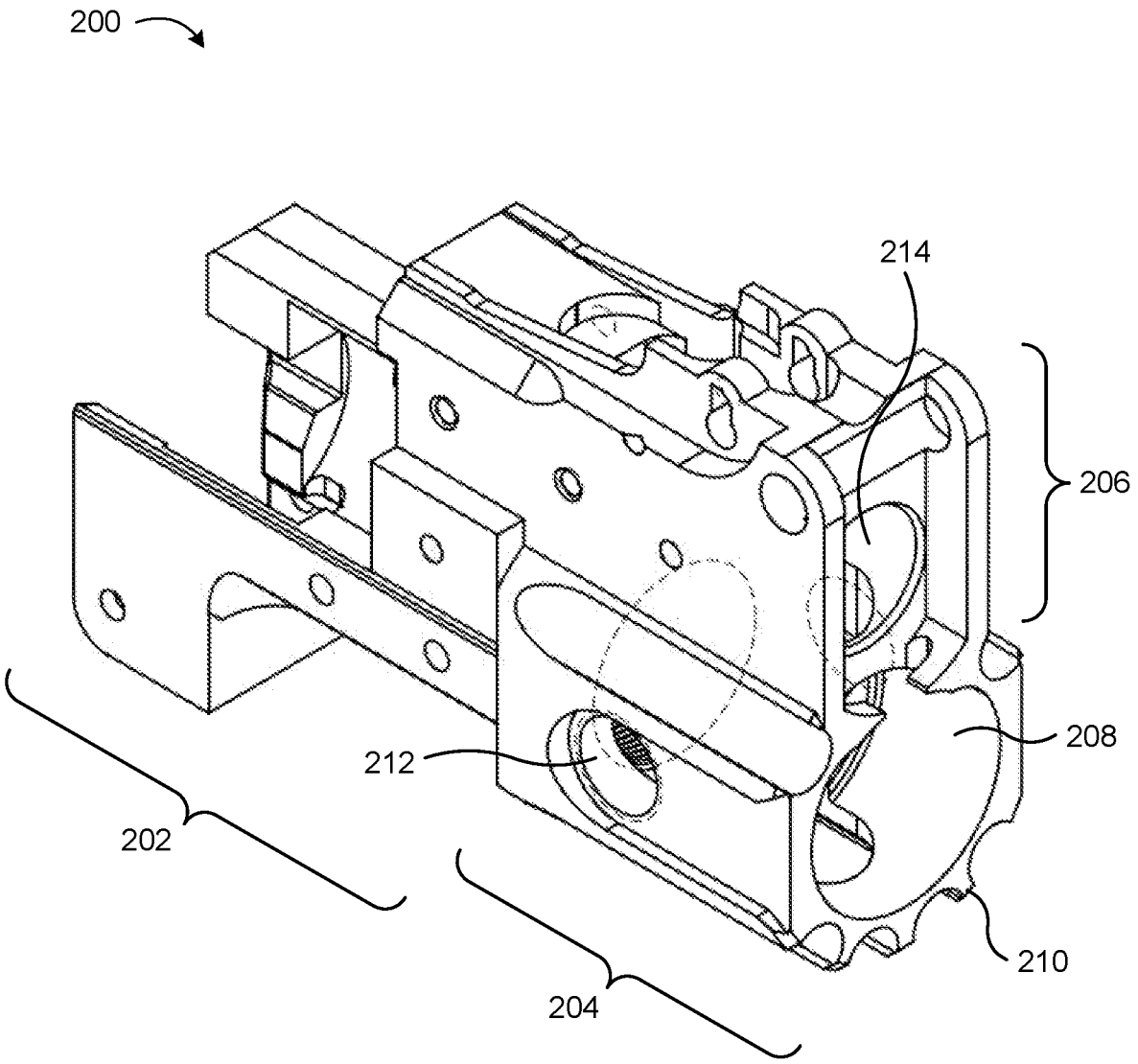
FIG. 2 is a perspective view illustrating one embodiment of a firearm barrel trunnion.
Figure 3:
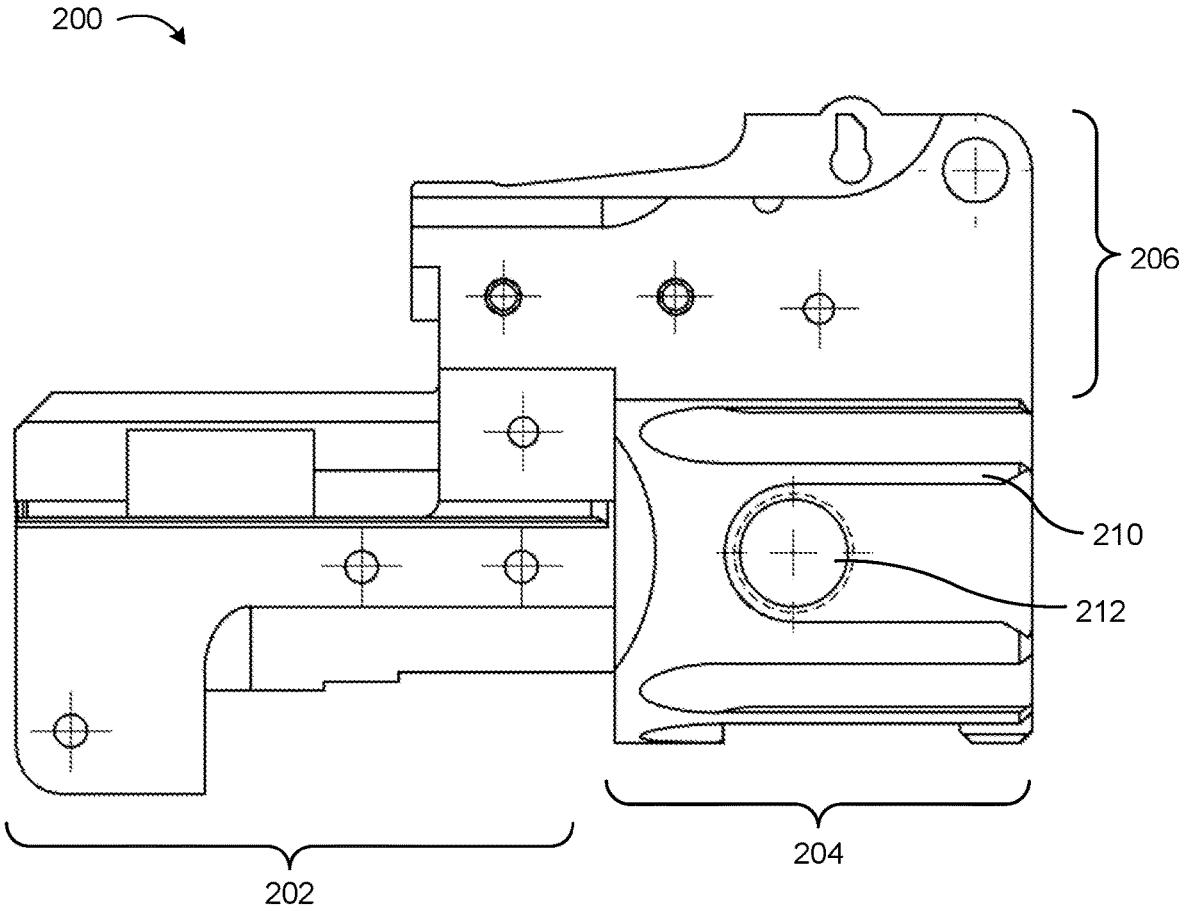
FIG. 3 is a side view further illustrating the trunnion of FIG. 2.

FIGS. 2 and 3 depict one embodiment of a firearm barrel trunnion 200, which may be substantially as described above with reference to the trunnion for the firearm 100 of FIG. 1. FIG. 2 depicts the trunnion 200 in a perspective view, and FIG. 3 depicts the trunnion in a side view.

In the depicted embodiment, the trunnion 200 includes a rear portion 202, a front portion 204, and a top portion 206. The trunnion 200 may be formed of steel or another suitably rigid material that can withstand repeated impact from the bolt of the firearm 100. The rear portion 202 of the trunnion 200 is shaped to couple to the receiver 106 for a firearm 100. For example, in the depicted embodiment, the outer surface of the rear portion is shaped to engage with an inner surface of an opening and the front of the receiver 106. The rear portion 202 of the trunnion 200 includes side openings to fasten the trunnion 200 in place within the receiver 106. In FIG. 1, the receiver 106 includes corresponding side openings, where the rear portion 202 of the trunnion 200 is coupled to the receiver 106.

The front portion 204 of the trunnion 200, in the depicted embodiment, is shaped to couple to a handguard 104 for the firearm 100 and to support the handguard 104 without the handguard 104 contacting other components of the firearm 100. In general, in various embodiments, a trunnion 200 or front portion 204 shaped to couple to and support a handguard 104 may include a contact surface that engages or mates to a complementary surface on the handguard 104, where the shape and/or area of the contact surface is sufficient to maintain the position of the handguard 104 without the handguard 104 being supported by other components of the firearm 100 forward of the trunnion 200. Thus, forces on the handguard 104 as a user holds or operates the firearm 100 may impinge on the contact surface of the trunnion 200 without the handguard 104 contacting components such as the barrel 102, gas tube, gas block, or the like.

The front portion 204, in the depicted embodiment, includes a fluted exterior surface 210. The outer edges of the fluted surface 210 will contact the handguard 104, thus supporting the handguard 104 but reducing heat transfer and weight compared to a non-fluted exterior surface. However, a trunnion 200 in another embodiment, may include an exterior surface with a non-fluted shape and may still support a handguard 104 as describe above. Additionally, in the depicted embodiment, the front portion 204 includes side openings 212 for attaching the handguard 104 via quick detach (QD) sling swivel sockets. In another embodiment, however, the handguard 104 may fasten to the trunnion 200 in another way.

A bore 208 is formed within the trunnion 200, and shaped to receive the barrel 102 of the firearm 100. The bore 208 may have a shape that conforms to the shape of the barrel so that the barrel 102 and the trunnion 200 can be assembled to be substantially rigid, compared to the lower rigidity of a stamped metal receiver.

The top portion 206 of the trunnion 200, in the depicted embodiment, is formed as a rear sight block for the firearm 100. An opening 214 is formed in the top portion 206 for receiving a gas piston for the firearm 100. A rear sight block for an AK-47 type rifle may have upper components for mounting rear sights, and may be of sufficient height to position the rear sights above the gas tube (so that a user can see the front sight). Thus, with the rear sight block extending to a greater height than the gas tube, the gas piston may extend backwards from the gas tube to the bolt carrier, through the opening 214 in the rear sight block.

In some AK-47 type rifles, the rear sight block and the trunnion are formed separately, and the rear sight block is press-fit, pinned, clamped, or otherwise attached to the barrel 102, in front of the trunnion. However, this attachment to the barrel may change the barrel harmonics, with a negative effect on accuracy. Thus, in the depicted embodiment, the top portion 206 of the trunnion 200 is formed as a rear sight block integral to the trunnion 200, instead of having a rear sight block separately pinned to the barrel 102. Additionally, having the rear sight block as a unitized or integral part of the trunnion 200 may prevent the sight block from moving independently of the rigid trunnion/barrel assembly, thus improving the accuracy of the firearm 100. In another embodiment, however, the top portion of the trunnion 200 may not be an integral rear sight block, but may provide attachment points for a non-integral rear sight block. Rigidly attaching a rear sight block to a trunnion instead of to the barrel 102 may similarly increase accuracy by avoiding effects on barrel harmonics, even if the rear sight block is not integral to the trunnion 200.

Figure 4:
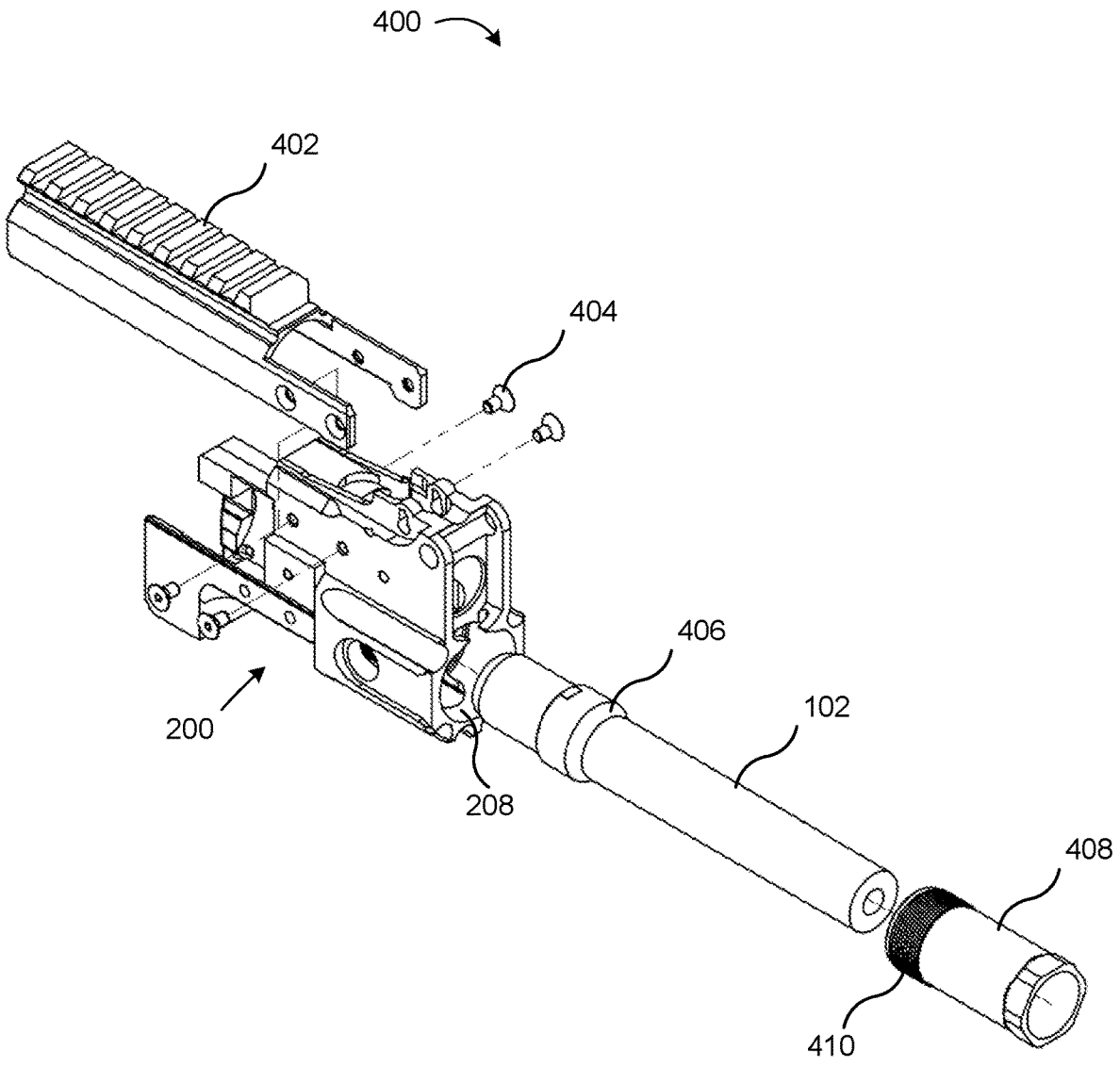
FIG. 4 is an exploded view illustrating assembly of a trunnion with other components of a firearm, in one embodiment.
Figure 5:
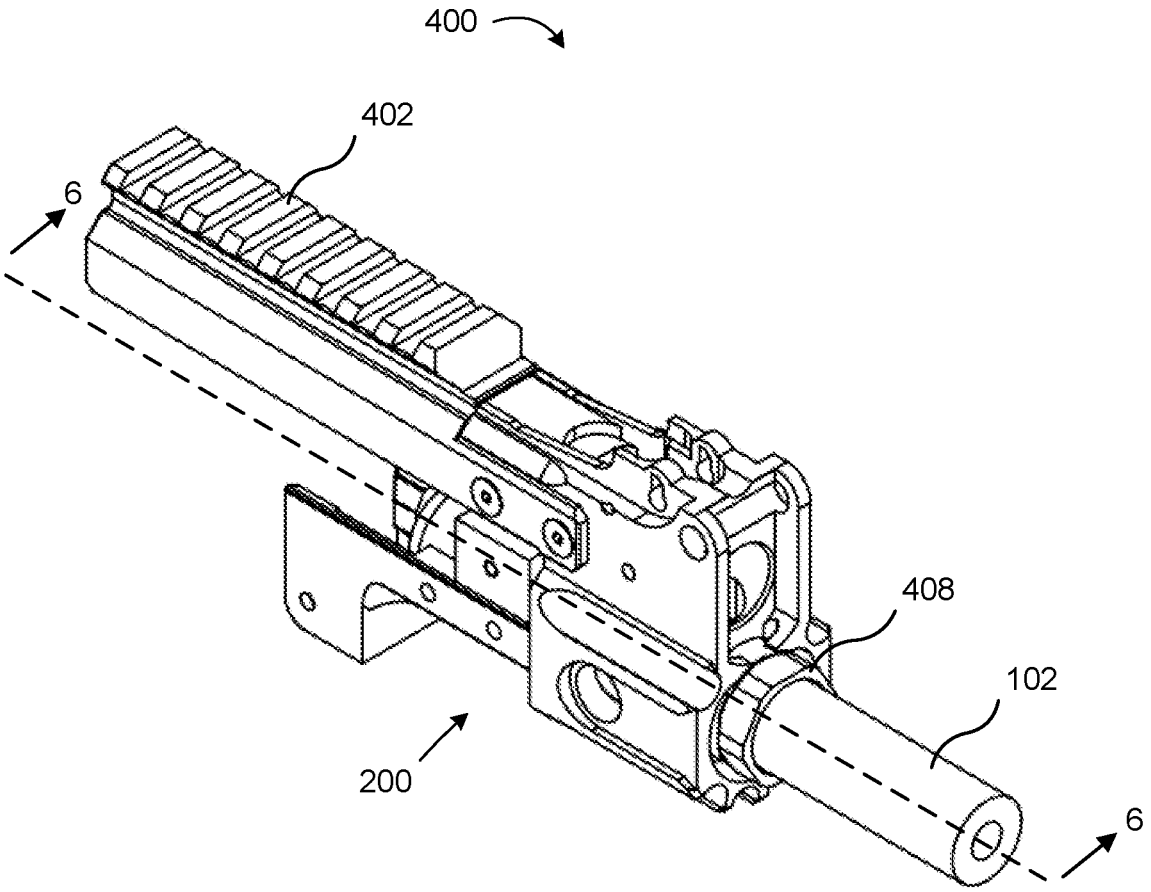
FIG. 5 is a perspective view illustrating components of FIG. 4 in their assembled state.
Figure 6:
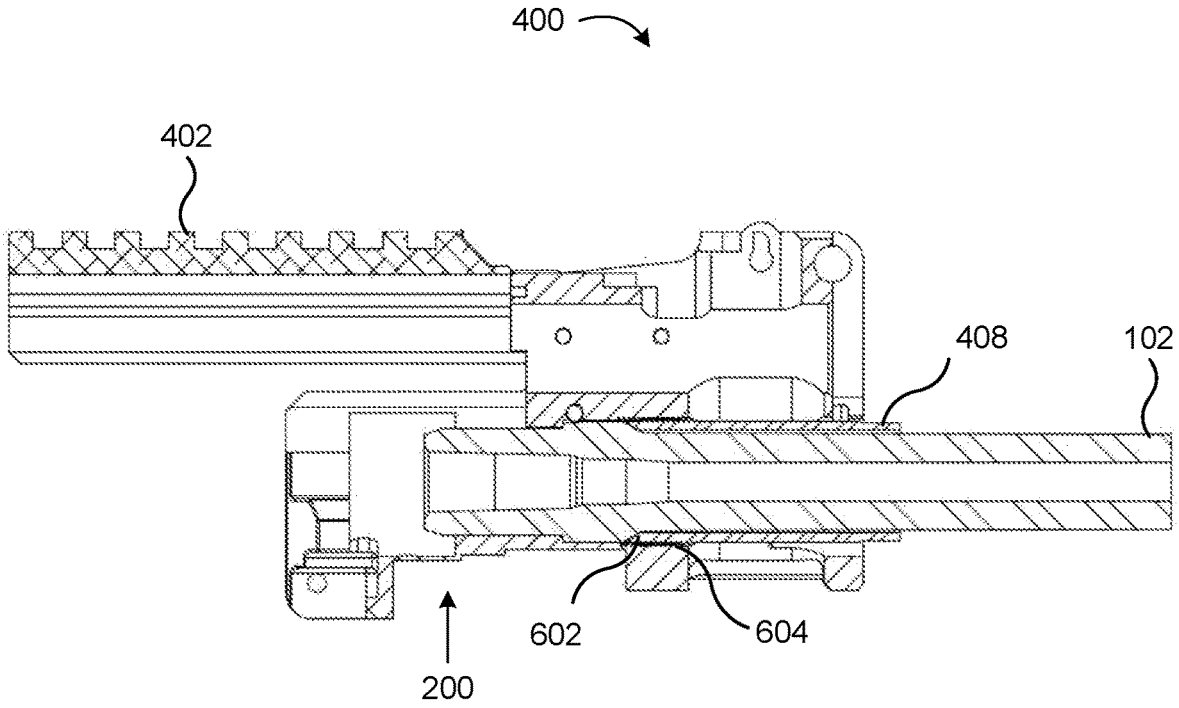
FIG. 6 is a cross section view further illustrating the assembled components of FIG. 5.

FIGS. 4, 5, and 6 illustrate an assembly 400 including the trunnion 200 as described above, with other components for a firearm 100. FIG. 4 depicts an exploded view of the assembly 400, and FIG. 5 depicts the same assembly 400 in its assembled (non-exploded) state. FIG. 6 depicts a cross section of the assembly 400, taken in the direction indicated by the dashed line and arrows in FIG. 5.

In the depicted embodiment, a scope mount 402 is coupled to the top portion 206 of the trunnion 200 by fasteners 404. A scope mount 402 includes mounting points for a telescopic sight (or "scope"). In the depicted embodiment, the scope mount 402 includes an attachment rail for mounting a scope, which may be a Picatinny (MIL-STD-1913) rail, a STANAG 4694 NATO accessory rail, or the like. Various other types of scope mount may include various other or further scope mounting points, corresponding to various types of scopes. In some embodiments, rather than fastening to the top portion 206, a scope mount 402 may be integrally formed as part of the top portion 206.

The barrel 102 is inserted into the bore 208 of the trunnion 200, and secured to the trunnion 200 by a barrel nut 408. In the depicted embodiment, the bore is internally threaded, and the barrel nut 408 is externally threaded to engage the bore. External threads 410 of the barrel nut are shown in FIG. 4, and internal threads 604 of the bore are shown in FIG. 6.

In the depicted embodiment, the barrel 102 includes a tapered shoulder portion 406 (shown in FIG. 4), and the barrel nut 408 includes a tapered internal portion 602 (shown in FIG. 6). As the barrel nut 408 is tightened, the tapered internal portion 602 of the barrel nut 408 engages the tapered shoulder portion 406 of the barrel 102, to align the barrel with the bore 208. In various embodiments, threaded and/or tapered barrel attachments to the trunnion 200 may allow users to service, remove, or interchange barrels with reliable headspacing and barrel alignment. Pin locks are not used with this type of attachment, thus avoiding drilling pin holes in the barrel, which may negatively affect barrel harmonics.

Figure 7:
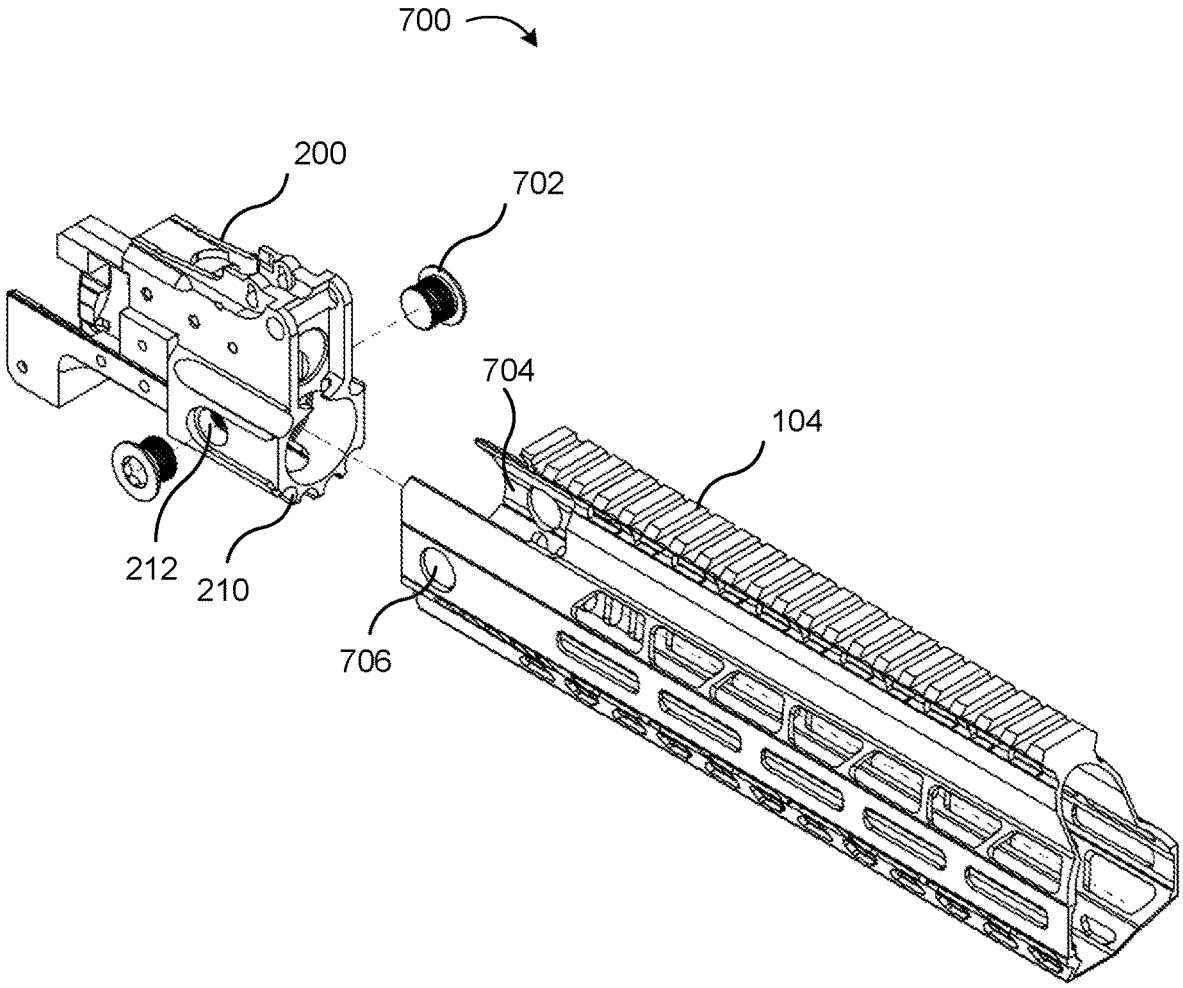
FIG. 7 is exploded view illustrating assembly of a trunnion with a handguard for a firearm, in one embodiment.
Figure 8:
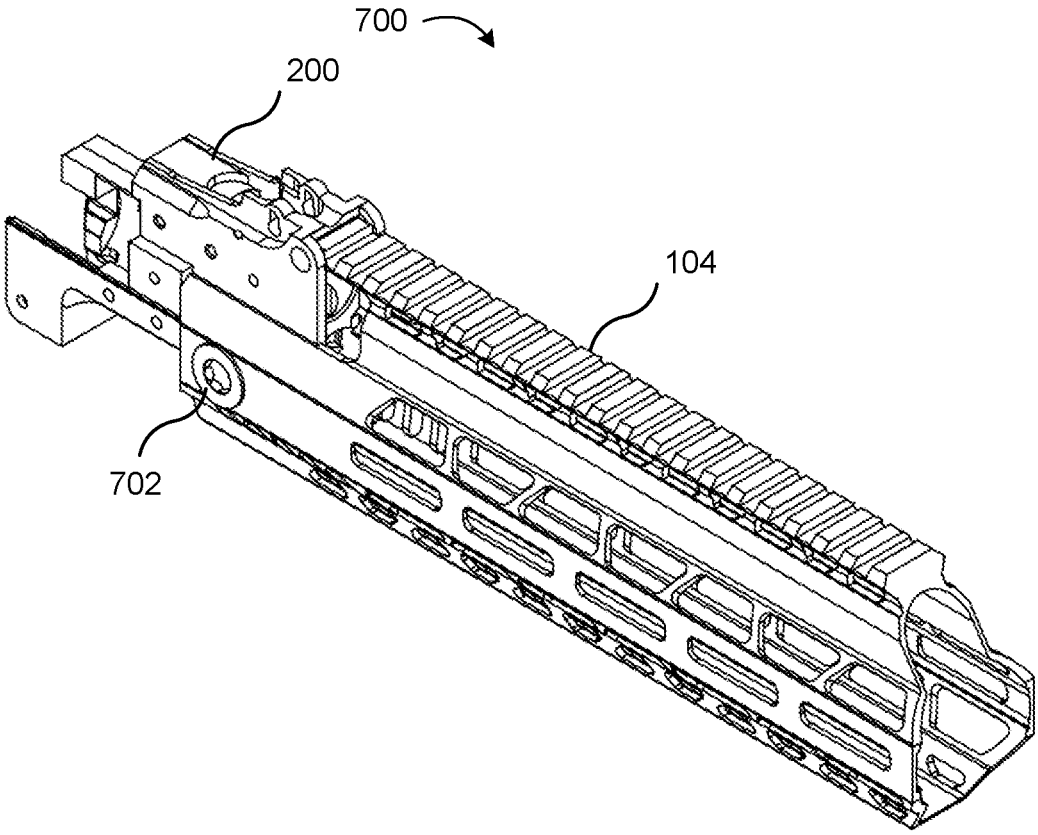
FIG. 8 is a perspective view illustrating components of FIG. 7 in their assembled state.

FIGS. 7 and 8 illustrate an assembly 700 including the trunnion 200 and a handguard 104 for a firearm 100, as described above. FIG. 7 depicts an exploded view of the assembly 700, and FIG. 8 depicts the same assembly 700 in its assembled (non-exploded) state. In the depicted embodiment the trunnion 200 includes a front portion with a fluted exterior surface 210 as described above, and the handguard 104 includes an interior contact surface 704 shaped to engage the fluted exterior surface 210. The interior contact surface 704 for the handguard 104 contacts the outer edges of the fluted surface 210, thus reducing heat transfer from the trunnion 200 to the handguard 104 (in comparison to a joint with greater surface area between contacting surfaces), which may cause operator discomfort.

In the depicted embodiment, the handguard 104 is coupled to the front portion of the trunnion 200 via quick detach (QD) sling swivel sockets 702 that engage side openings 706 in the handguard 104 and corresponding side openings 212 in the front portion of the trunnion 200. In another embodiment, another type of fastener may be used to couple handguard 104 to a trunnion 200. With the handguard 104 securely coupled to the trunnion 200, the front portion of the trunnion 200 supports the handguard without the handguard contacting other components of the firearm. Thus, with the trunnion 200 and barrel 102 assembled as described with reference to FIGS. 4-6, and the handguard 104 added as described with reference to FIGS. 7-8, the barrel 102 is free-floating such that forces on the handguard 104 during use of the firearm 100 are not transferred to the barrel 102 except via the trunnion 200. Even with a stamped sheet metal receiver 106 for a standard AK-47 type rifle, the use of a trunnion 200 as described herein to support a free-floating barrel 102 and handguard 104 may provide greatly increased accuracy compared to using a standard AK-47 trunnion.

Figure 9:
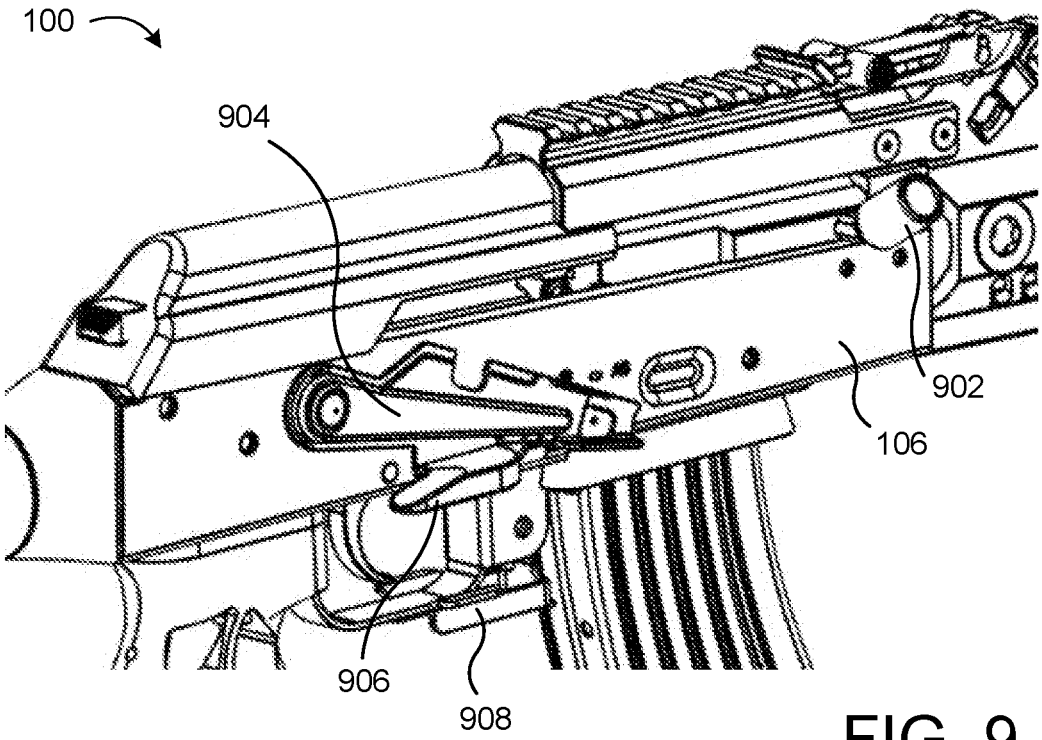
FIG. 9 is a perspective view further illustrating a portion of the firearm of FIG. 1.
Figure 10:
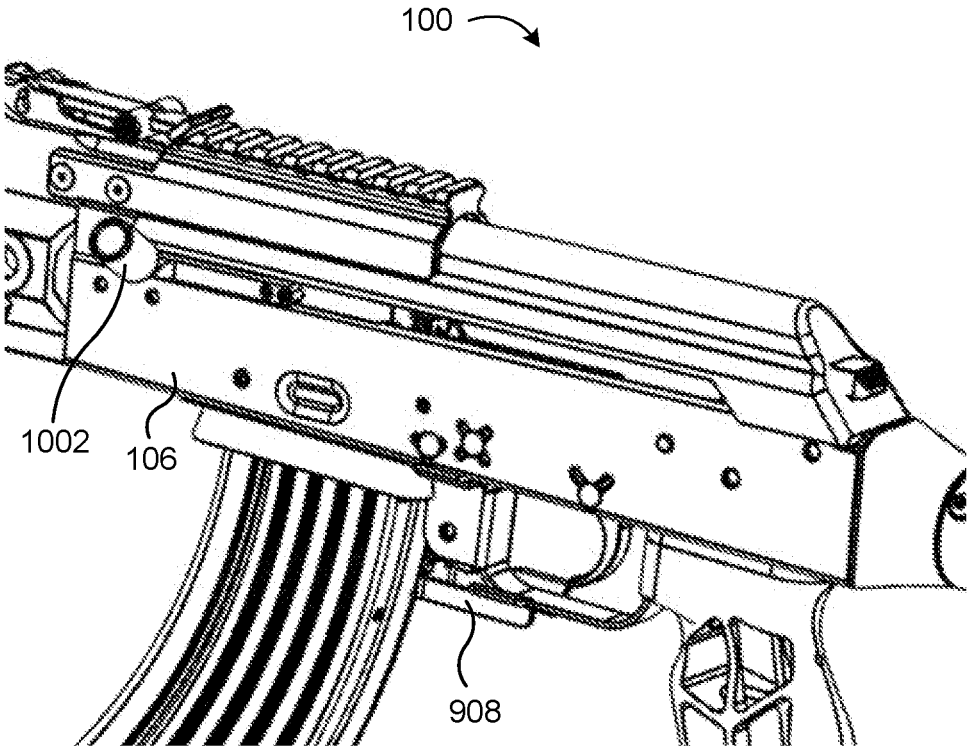
FIG. 10 is a perspective view further illustrating a portion of the firearm of FIG. 1.

FIGS. 9 and 10 illustrate a portion of the firearm 100 of FIG. 1 near the receiver 106, to show details that are not as clearly visible in FIG. 1. FIG. 9 depicts a view from the right side of the firearm 100 and FIG. 10 depicts a view from the left side. In the depicted embodiment, the firearm includes charging handles 902, 1002, a safety lever 904, a safety lever extension 906, and a magazine release 908, which are described below. Although a left charging handle 1002 and a right charging handle 902 are depicted for ambidextrous use, some embodiments of a firearm 100 may include one of the two charging handles 902, 1002, according to user preference.

In the original AK-47 design, a right charging handle is integral to a bolt carrier, and extends through a slot in the cover for the receiver 106. For fast reloading, it would be advantageous to operate the magazine release 908 with the right hand (since the right hand is already near the trigger), allow the old magazine to fall, and use the left hand to insert a new magazine and pull back the charging handle to chamber a round. However, the original AK-47 design does not provide a left charging handle. Thus, in the depicted embodiment, charging handles 902, 1002 are detachably coupled to the bolt carrier, allowing a user to decide whether to have a left charging handle 1002, a right charging handle 902, or both.

Figure 11:
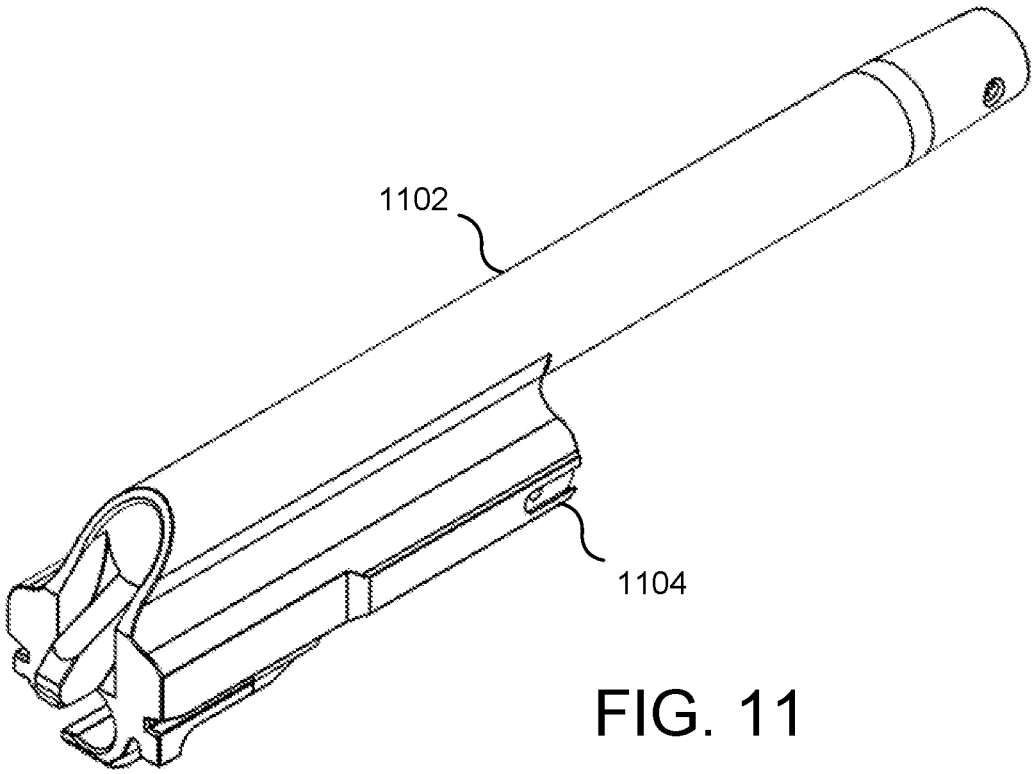
FIG. 11 is a perspective view illustrating one embodiment of a bolt carrier for a firearm.
Figure 12:
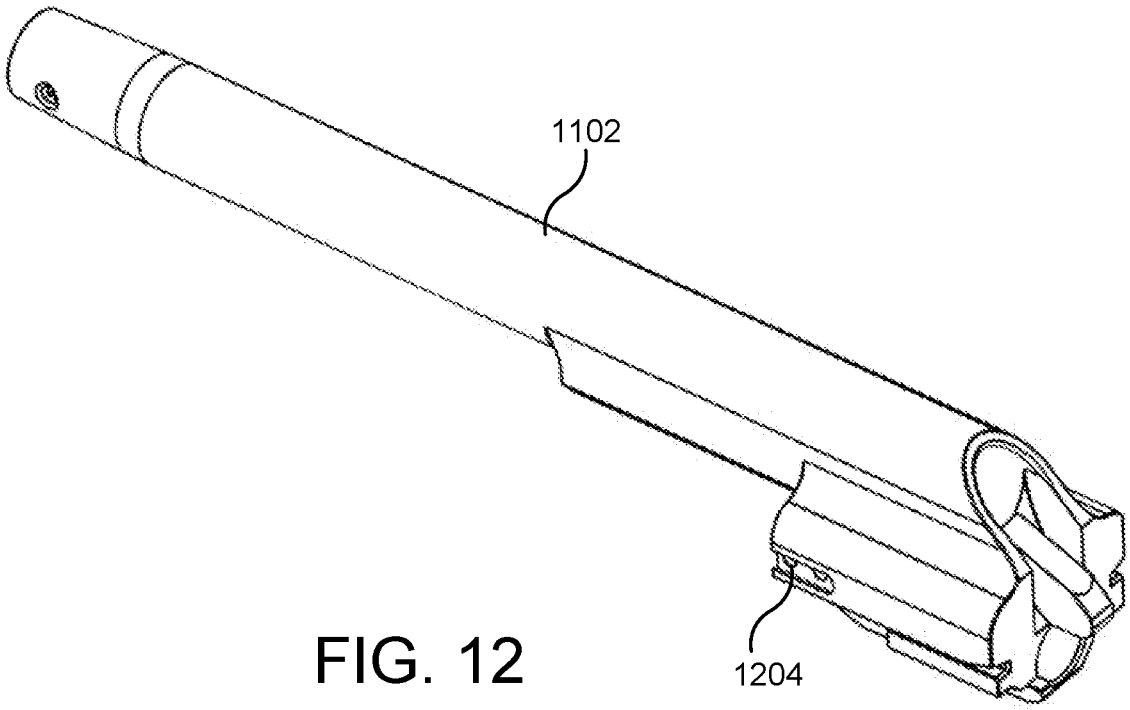
FIG. 12 is a perspective view further illustrating the bolt carrier of FIG. 11.
Figure 13:
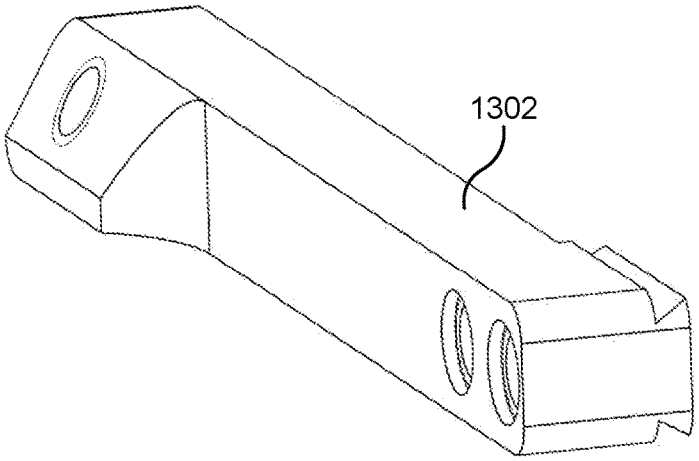
FIG. 13 is a perspective view illustrating one embodiment of a charging handle coupler for a firearm.
Figure 14:
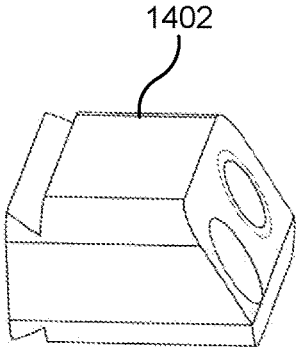
FIG. 14 is a perspective view illustrating another embodiment of a charging handle coupler for a firearm.

FIGS. 11 and 12 depict one embodiment of a bolt carrier 1102 fora firearm 100, in perspective views from the right and from the left, respectively. A left dovetail opening 1204 and a right dovetail opening 1104 are formed in the bolt carrier. Operating the charging handle may involve a large amount of force for a fairly small handle, and an attachment point for a charging handle to connect to the bolt carrier 1102 may be of limited depth so as not to interfere with the operation of the bolt carrier 1102. A dovetail opening 1104, 1204 is shaped to admit a dovetail-shaped connector as depicted in FIGS. 13 and 14. The strength and limited depth of a dovetail joint allow a charging handle to be securely attached to the bolt carrier 1102 without interfering with other components.

Figure 15:
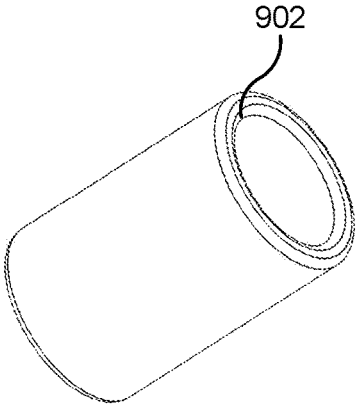
FIG. 15 is a perspective view illustrating one embodiment of a charging handle for a firearm.
Figure 16:
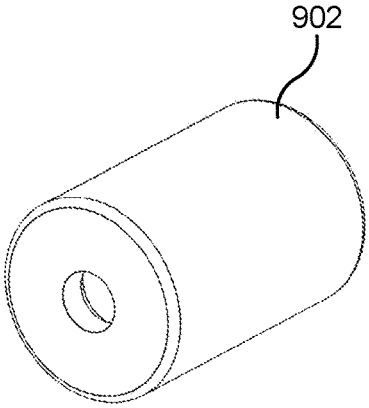
FIG. 16 is a perspective view further illustrating the charging handle of FIG. 15.

FIGS. 13 and 14 depict two different embodiments of charging handle couplers 1302, 1402 for a firearm. FIG. 13 depicts a charging handle coupler 1302 for the left side, and FIG. 14 depicts a charging handle coupler 1402 for the right side. Both couplers 1302, 1402 include dovetails to engage the dovetail openings described above, holes for set screws to secure the charging handle couplers 1302, 1402 in the dovetail openings, and a hole for a screw to secure the charging handles 902, 1002 to the charging handle couplers. (FIGS. 15 and 16 depict different views of a charging handle 902, with a hole on one side large enough for a screw head and a screwdriver, and a smaller hole on the other side)

Because the bolt carrier 1102 is asymmetric, the left dovetail opening 1204 is further back than the right dovetail opening 1104. Thus, the charging handle coupler 1302 for the left side is elongate, so that the left charging handle 1002 is forward of the left dovetail opening 1204. The charging handle coupler 1402 for the right side is not similarly elongate in the depicted embodiment. However, on either side, a charging handle coupler may be elongate in certain embodiments, to position a charging handle forward of a dovetail opening. In various embodiments, a user may select a longer or shorter charging handle coupler to position a charging handle at a preferred location.

Additionally, in the depicted embodiments, the charging handle couplers 1302, 1402 are shaped to position the charging handle at a 30 degree up-angle from horizontal. A slanted surface on the charging handle couplers 1302, 1402 positions the handle at the desired angle. In another embodiment, charging handle couplers 1302, 1402 may use a vertical surface so that the handle is horizontal rather than up-angled. However, some users may find angled charging handles more comfortable.

Figure 17:
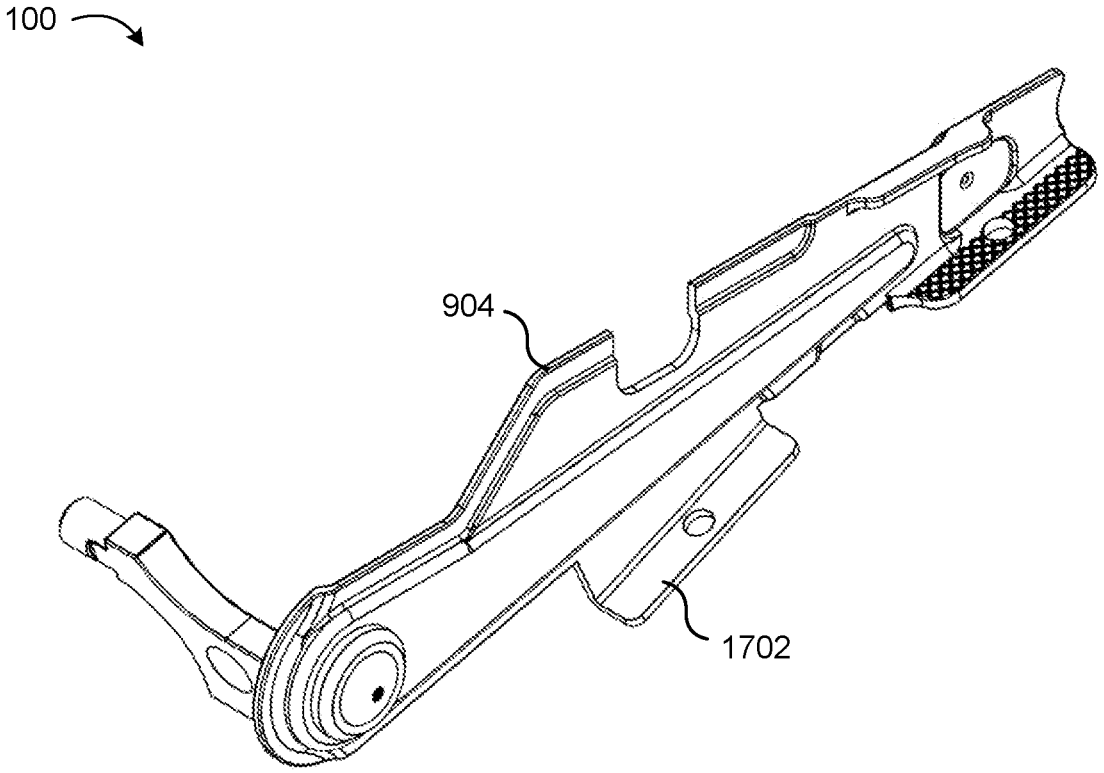
FIG. 17 is a perspective view illustrating one embodiment of a safety lever for a firearm.
Figure 18:
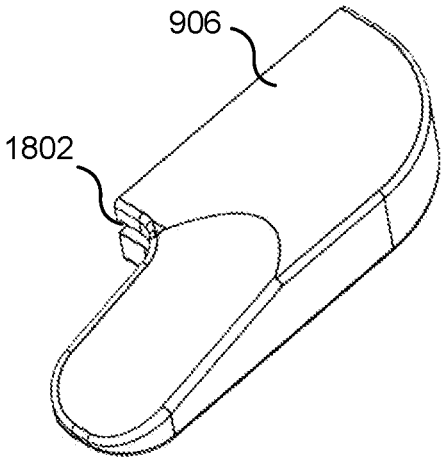
FIG. 18 is a perspective view illustrating one embodiment of a safety lever extension for a firearm.
Figure 19:
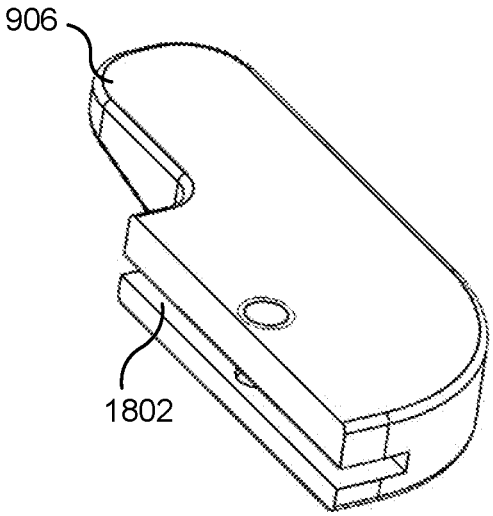
FIG. 19 is a perspective view further illustrating the safety lever extension of FIG. 18.

FIG. 17 depicts one embodiment of a safety lever 904 for a firearm 100, and FIGS. 18 and 19 depicts two different views of a safety lever extension 906, from above and from below. Referring to FIG. 10, a safety lever 904 for an AK-47 type firearm may extend significantly forward of the trigger, and may (without an extension 906) be difficult to operate with the right hand). Additionally, a sheet metal safety lever 904 without an extension 906 may be painful to operate. Thus, in the depicted embodiment, the safety lever 904 includes a tab 1702 that fits into a slot 1802 in an ergonomic safety lever extension 906, so that the safety lever extension 906 can be removably coupled to the safety lever 904 in a position above the trigger.

Figure 20:
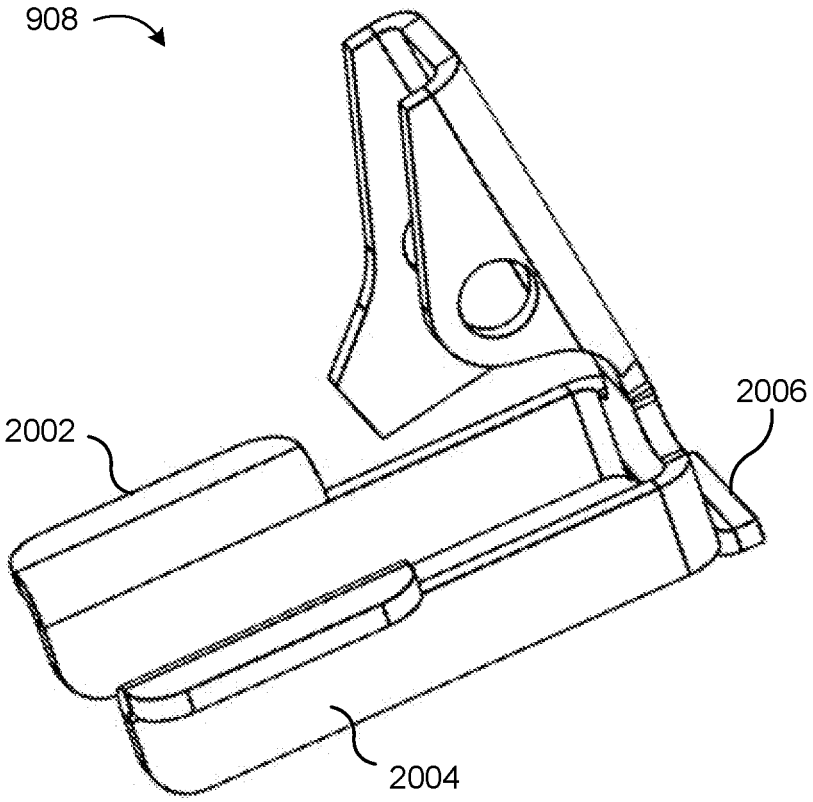
FIG. 20 is a perspective view illustrating a magazine release for a firearm, in one embodiment.

FIG. 20 depicts a magazine release 908 for a firearm 100, in one embodiment. The magazine release 908 is depicted in relation to other components in FIGS. 9 and 10. The magazine release 908 is positioned forward of a trigger guard for the firearm 100. Two extensions 2002, 2004 extend rearward along left and right sides of the trigger guard. A forward extension 2006 extends forward to push a released magazine away from the firearm 100 when the magazine release 908 is operated. A user operates the magazine release 908 by pushing down on one of the extensions 2002, 2004 so that the magazine release 908 pivots forward, releasing the magazine. As the magazine release 908 pivots forward, the forward extension 2006 pushes against the back of the magazine to push it out of the firearm 100. In some embodiments, the forward extension 2006 includes a roller bearing to roll, rather than slide, against the back of the magazine when pushing the magazine away.

Embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:
a firearm barrel trunnion comprising:
a rear portion shaped to couple to a receiver for a firearm;
a front portion shaped to couple to a handguard for the firearm and to support the handguard without the handguard contacting other components of the firearm; and
a bore formed within the trunnion, the bore shaped to receive a barrel for the firearm.

2. The apparatus of claim 1, wherein the front portion comprises a fluted exterior surface.

3. The apparatus of claim 2, further comprising the handguard, the handguard comprising an interior contact surface shaped to engage the fluted exterior surface of the front portion of the trunnion.

4. The apparatus of claim 1, wherein the front portion comprises side openings for attaching the handguard via quick detach (QD) sling swivel sockets.

5. The apparatus of claim 1, further comprising the barrel and a barrel nut for securing the barrel in the bore, wherein:
the barrel comprises a tapered shoulder portion; and
the barrel nut comprises a tapered internal portion to engage with the tapered shoulder portion of the barrel, to align the barrel with the bore.

6. The apparatus of claim 5, wherein the bore is internally threaded and the barrel nut is externally threaded to engage the bore.

7. The apparatus of claim 1, wherein the firearm barrel trunnion further comprises a top portion integral to the trunnion, the top portion formed as a rear sight block for the firearm and having an opening formed therein for receiving a gas piston for the firearm.

8. The apparatus of claim 7, further comprising a scope mount attached to the top portion.

9. A firearm comprising:
a receiver;
a barrel;
a handguard; and
a firearm barrel trunnion, the trunnion comprising:
a rear portion coupled to the receiver;
a front portion coupled to the handguard, such that the front portion supports the handguard without the handguard contacting other components of the firearm; and
a bore formed within the trunnion, the bore coupled to the barrel.

10. The firearm of claim 9, wherein the barrel is free-floating such that forces on the handguard during use of the firearm are not transferred to the barrel except via the trunnion.

11. The firearm of claim 9, wherein the front portion of the trunnion comprises a fluted exterior surface that engages an interior contact surface of the handguard.

12. The firearm of claim 9, wherein the handguard is coupled to the front portion via quick detach (QD) sling swivel sockets that engage side openings in the handguard and the front portion.

13. The firearm of claim 9, further comprising a barrel nut that secures the barrel in the bore, wherein:
the barrel comprises a tapered shoulder portion; and
the barrel nut comprises external threads that engage internal threads of the bore, and a tapered internal portion that engages the tapered shoulder portion of the barrel and aligns the barrel with the bore.

14. The firearm of claim 9, further comprising a scope mount attached to a top portion of the trunnion, the top portion formed as a rear sight block integral to the trunnion and having an opening formed therein that receives a gas piston.

15. The firearm of claim 9, further comprising a bolt carrier, a charging handle, and a charging handle coupler, wherein the bolt carrier has left and right dovetail openings formed therein, the charging handle coupler is coupled to one of the dovetail openings, and the charging handle is coupled to the charging handle coupler.

16. The firearm of claim 15, wherein the charging handle coupler is elongate such that the charging handle is forward of a dovetail opening to which the charging handle coupler is coupled.

17. The firearm of claim 15, wherein the charging handle coupler is shaped to position the charging handle at a 30 degree up-angle from horizontal.

18. The firearm of claim 9, further comprising a safety lever and a safety lever extension removably coupled to the safety lever above the trigger.

19. The firearm of claim 9, further comprising a magazine release positioned forward of a trigger guard, the magazine release comprising two extensions that extend rearward along left and right sides of the trigger guard, and a forward extension that extends forward to push a released magazine away from the firearm when the magazine release is operated.

20. A method comprising:
providing a receiver for a firearm;
providing a barrel for the firearm;
providing a handguard for the firearm;
providing a firearm barrel trunnion for the firearm;
coupling a rear portion of the trunnion to the receiver;
coupling the barrel to a bore formed within the trunnion; and
coupling the handguard to a front portion of the trunnion, such that the front portion supports the handguard without the handguard contacting other components of the firearm.

* * * * *